US011267001B2

(12) United States Patent
Xu

(10) Patent No.: US 11,267,001 B2
(45) Date of Patent: Mar. 8, 2022

(54) FOUNTAIN CORE AND FOUNTAIN DEVICE HAVING FOUNTAIN CORE

(71) Applicant: Power Beauty Industrial Co., Ltd., DongGuan (CN)

(72) Inventor: Yiqun Xu, DongGuan (CN)

(73) Assignee: POWER BEAUTY INDUSTRIAL CO., LTD., DongGuan (CN)

( * ) Notice: Subject to any disclaimer, the term of this patent is extended or adjusted under 35 U.S.C. 154(b) by 0 days.

(21) Appl. No.: 16/521,889

(22) Filed: Jul. 25, 2019

(65) Prior Publication Data

US 2020/0316620 A1 Oct. 8, 2020

(30) Foreign Application Priority Data

Apr. 4, 2019 (CN) ..... 201910275209.1
Apr. 4, 2019 (CN) ..... 201920460620.1
Apr. 4, 2019 (CN) ..... 201920460632.4

(51) Int. Cl.
*B05B 1/02* (2006.01)
*B05B 17/08* (2006.01)

(52) U.S. Cl.
CPC ..... *B05B 1/02* (2013.01); *B05B 17/08* (2013.01)

(58) Field of Classification Search
CPC ..... B05B 1/02; B05B 17/08
USPC ..... 239/18, 22, 23
See application file for complete search history.

(56) References Cited

U.S. PATENT DOCUMENTS 3,393,643 A * 7/1968 Herman ..... F04D 13/066 415/7
4,819,874 A * 4/1989 Geiger ..... B05B 17/08 239/211
7,427,036 B2 * 9/2008 Skluzacek ..... B05B 17/08 239/18

* cited by examiner

*Primary Examiner* — Christopher S Kim
(74) *Attorney, Agent, or Firm* — Michael X. Ye; Rimon Law

(57) ABSTRACT

The present disclosure relates to a fountain device including: a fountain core and a floating portion. The fountain core includes a hydraulic portion and a power supply for providing power to the hydraulic portion and is configured to pump water from a water inlet at a lower portion by means of the hydraulic portion and spraying water via a water spout at an upper portion to form a fountain. The floating portion is configured to cause the fountain device to float in the water and forms a core mounting hole for holding the fountain core when inflated with a low density fluid, so that the fountain core can form a fountain by the hydraulic portion in a state that the fountain device floats in the water.

9 Claims, 8 Drawing Sheets

FOUNTAIN CORE AND FOUNTAIN DEVICE HAVING FOUNTAIN CORE

This application claims the benefit of the Chinese Patent Application No. 201920460632.4 filed on Apr. 4, 2019, Chinese Patent Application No. 201920460620.1 filed on Apr. 4, 2019 and Chinese Patent Application No. 201910275209.1 filed on Apr. 4, 2019, which are hereby incorporated by reference as if fully set forth herein.

BACKGROUND

The present disclosure relates to a fountain device, and in particular to a fountain device having an illumination mechanism.

DESCRIPTION OF THE RELATED ART

Chinese utility model application (publication number: CN206504207U) discloses a fountain lamp, including a housing and a water pipe tube disposed through a center of the housing. The housing is cylindrical housing opening on top thereof, the housing including an upper housing and a lower housing, and the upper and lower ends of the water pipe tube extending beyond the upper and lower housings respectively. The side walls of the upper and lower sides of the water pipe tube are evenly provided with fixing holes, and the fixing holes are provided with connecting rods for fixing. The circumferential outer edges of the upper and lower housings are evenly distributed a plurality of screw holes correspondingly, to enable the upper and lower housings to be fastened by screws. Both the upper and lower housings have screw holes so as to realize a tighter fixing and a more robust structure. With a larger size, large-area illumination of the landscape of the fountain enables a higher beam illumination.

SUMMARY

A fountain device in accordance with some embodiments includes a fountain core including a hydraulic portion and a power supply for providing power to the hydraulic portion and a floating portion configured to cause the fountain device to float in the water. The fountain core is configured to pump water from a water inlet at a lower portion of the hydraulic portion by means of the hydraulic portion and spray the water via a water spout at an upper portion of the hydraulic portion to form a fountain. The floating portion is configured to form a core mounting hole configured to hold the fountain core when inflated with a low density fluid, so that the fountain core can form the fountain by the hydraulic portion in a state that the fountain device floats in the water.

A fountain core in accordance with some embodiments includes a hydraulic portion configured to spray at least a portion of water entering water inlets of the hydraulic portion above a water surface to form a fountain; and a power supply configured to provide power to the hydraulic portion. The fountain core is configured to detachably couple to a floating portion to form a fountain device.

List of reference signs

Figure 1:
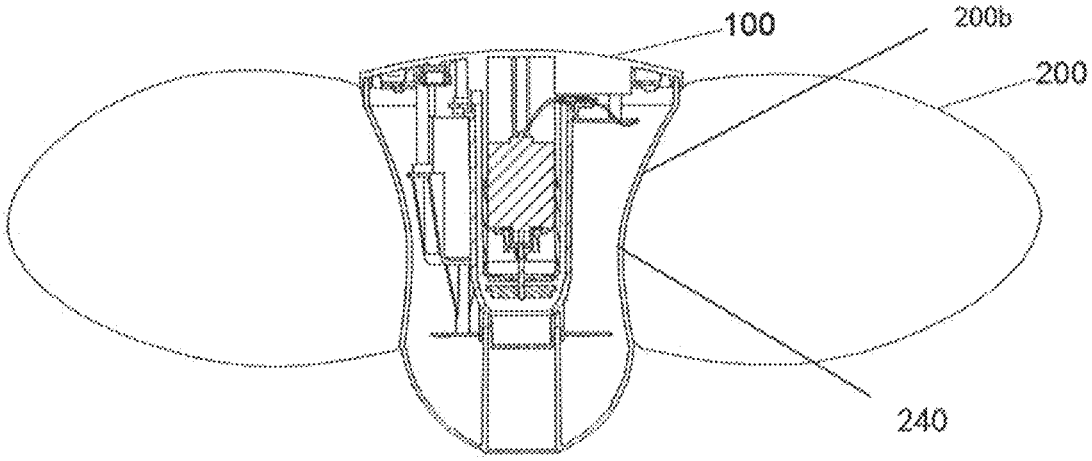
FIG. 1 is a simplified schematic view of some embodiments of the present disclosure.

| | | |
|---|---|---|
| 100: fountain core | 110: hydraulic portion | 120: power supply |
| 130: housing | 131: first section | 1311: water spout |
| 132: second section | 133: third section | 141: first lamp |
| 142: second lamp | 143: third lamp | 151: first chamber |
| 152: second chamber | 153: third chamber | 154: fourth chamber |
| 161: wire-through hole | 162: wire | 170: pump seat |
| 180: water blocking portion | 181: first inverted cone surface | 182: second inverted cone surface |
| 183: third inverted cone surface | 200: floating portion | 111: motor |
| 240: core mounting hole | 300: filter element | 410: wire binding portion |
| 420: limiting wire | 430: counterweight | 500: control board |
| 510: processor | 520: memory | 530: wireless module |
| 600: wireless remote controller | 700: charging interface | 800: switch |
| 112: impeller | 110a: water inlet | 100b: outer edge |
| 200a: interface | 200b: surface of floating portion | 141a: reflection part |
| 130a: circumferential wall | | |

DETAILED DESCRIPTION

However, the inventor found that the fountain lamp in the related art occupies large spaces when not in use, because the main components for providing buoyancy employ rigid housings. Therefore, it is inconvenient to be stored. The inventor proposes a new fountain lamp. The Description thereof will be illustrated in detail below with reference to FIGS. 1-12.

In some embodiments of the present disclosure, a fountain device includes a fountain core 100 and a floating portion 200. The fountain core 100 can be mounted on the floating portion 200.

The fountain core 100 includes a hydraulic portion 110 and a power supply 120 that provides power to the hydraulic portion 110. The fountain core 100 absorbs water from a water inlet 110*a* located at a lower portion thereof by means of the hydraulic portion 110 and sprays water through a water spout 1311 located at an upper portion of the fountain core 110 to form a fountain. The hydraulic portion 110 is, for example, various types of water pumps.

The floating portion 200 functions so that the fountain device floats in the water, and the floating portion 200 may be a rigid hollow housing or a flexible housing. In the case of a flexible foldable housing, the floating portion 200 can form a core mounting hole 240 for holding the fountain core 100 after it is inflated with a low density fluid, such that the fountain core 100 can form a fountain by means of the hydraulic portion 110 in a state that the fountain device floats in water.

In some embodiments, the core mounting hole 240 is capable of forming a configuration that at least partially matches a shape of the housing 130 of the fountain core 100 in the event that the floating portion 200 is injected with a low density fluid such that in the event that the floating portion 200 is injected a low density fluid, the floating portion 200 inflates and at least a portion of its surface 200*b* at the core mounting hole 240 is supported on the wall of the housing 130 of the fountain core 110, so as to mount the fountain core 100 on the floating portion 200 via the core mounting hole 240 supporting the fountain core 100. The core mounting hole 240 can be formed in a configuration that is large at both ends and small in the middle. The portion of the housing 130 of the fountain core 100 that is mounted within the core mounting hole 240 may also have a configuration that substantially matches the configuration of the housing mounting hole 240, i.e., a configuration that is large at both ends and small in the middle.

In some embodiments, the floating portion 200 can employ an inflatable balloon. In at least one embodiment, the floating portion 200 may be provided with a gas nozzle for charging and discharging gas. When the balloon is charged with gas, the balloon inflates and at least a portion of its surface 200*b* at the core mounting hole 240 applies a tightening force to the housing 130 of the fountain core 100. The core mounting hole 240 in the floating portion 200 inflated with a low density fluid is capable of holding the fountain core 100 in the floating portion 200 as well as allowing the fountain core 100 to float on the water surface.

In some embodiments, when the balloon is charged with gas, the balloon is inflated and at least a portion of its surface 200*b* at the core mounting hole 240 can support on the wall of the housing 130 of the fountain core 100 that is large at both ends and small in the middle, to mount the fountain core 100 on the floating portion 200 via the balloon holding the fountain core 100. Thereby, while the floating portion 200 in the inflated state is capable of holding and stabilizing the fountain core 100, the gap between the balloon and the fountain core is reduced.

In some embodiments, one end of the floating portion 200 has an interface 200*a* for connecting with the fountain core 100. This interface 200*a* is used, for example, to thread tighten the fountain core 100 to the core mounting hole 240, see FIGS. 2, 6, 7, 8 and 9. The interface 200*a* allows the fountain device to assume a fixed orientation such that its geometric center or center of gravity extends through the core mounting hole 240. Instead of a thread interface, the fountain core 100 can also be attached to the floating portion 200 by means of Velcro, for example.

In some embodiments, the hydraulic portion 110 conveys water through a water inlet 110*a* of the hydraulic portion 110 to a water spout 1311 to form a fountain. The fountain device has a plurality of water spouts 1311 distributed on its top surface in the circumferential direction, in particular along at least two circumferential lines. During the water spraying process, the fountain device moves in a horizontal direction on the water surface due to the reaction force of the fountain on the fountain device. The fountain sprayed from the fountain device falls to the water surface and causes fluctuations, which indirectly cause a change in the direction of the spraying to result in a dynamically changing horizontal component of movement; or, the fountain sprayed from the fountain device falls to hit the fountain device, which directly cause a change in the direction of the spraying to result in a dynamically changing horizontal component of movement.

In some embodiments, the bottom of the floating portion can be anchored to the bottom of the pool by means of a wire which is connected to a counterweight, whereby the fountain device can move in a circular motion with the water spray.

In some embodiments, the fountain core 100 further includes a multiple of first lamps 141. The first lamp 141 is mounted within a first chamber and extends at least a portion of the first lamp 141 out of the housing 130, such that light emitted from the first lamp 141 is at least partially directed obliquely toward the fountain sprayed from the fountain core.

Figure 4:
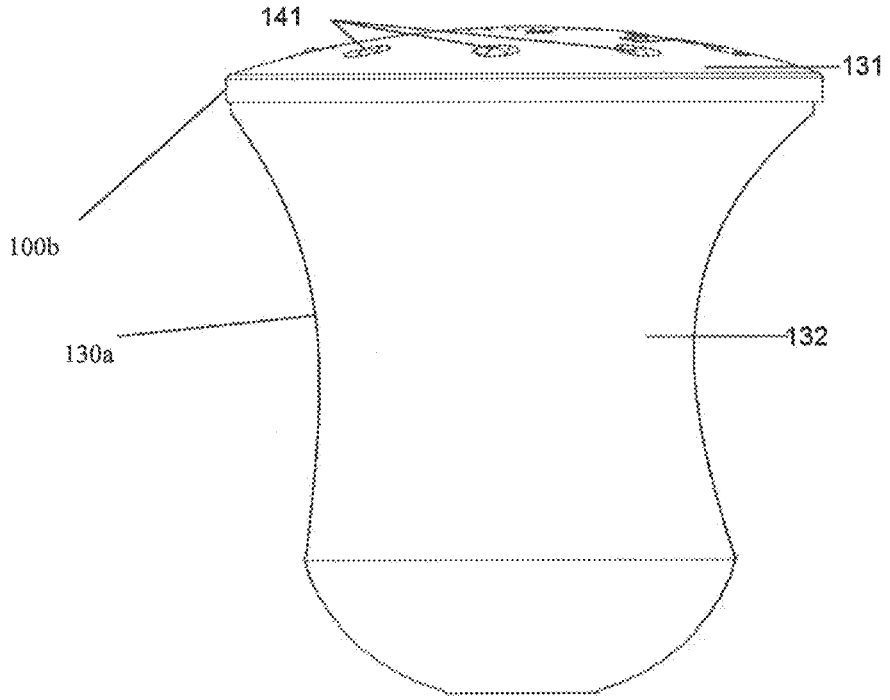
FIG. 4 is a simplified external side view of at least one embodiment of the fountain core.
Figure 5:
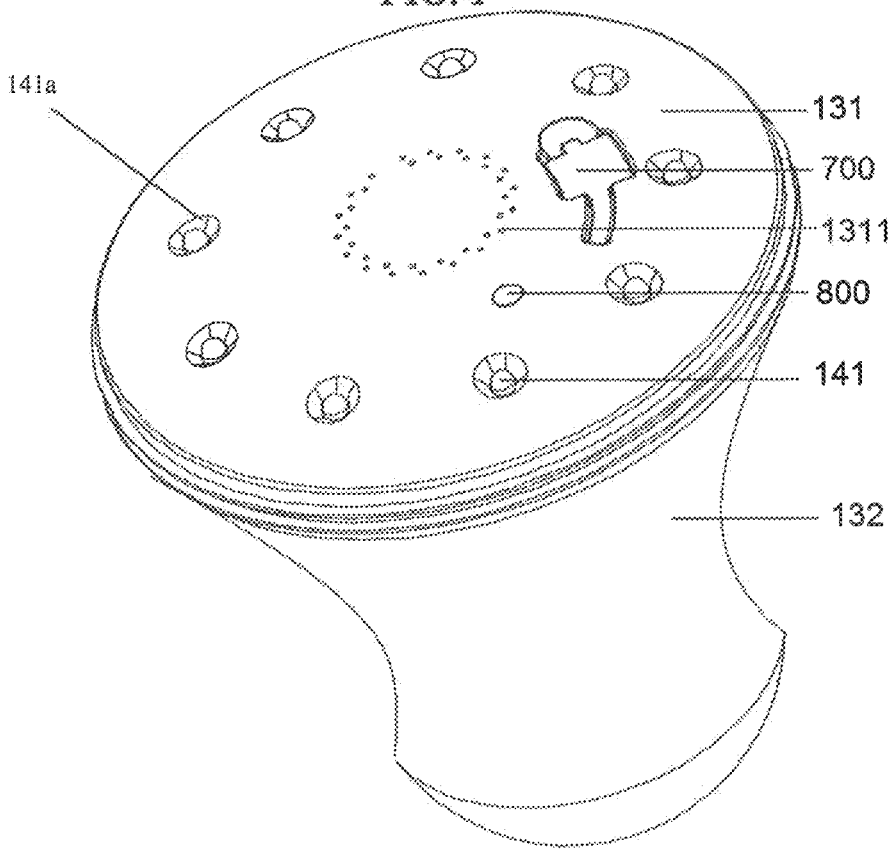
FIG. 5 is another simplified external side view of at least one embodiment of the fountain core.
Figure 6:
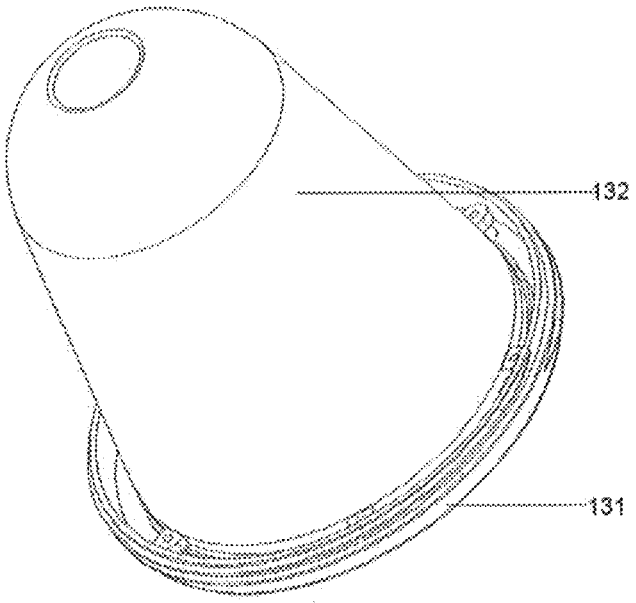
FIG. 6 is an isometric view of at least one embodiment of the fountain core viewed from one perspective.
Figure 7:
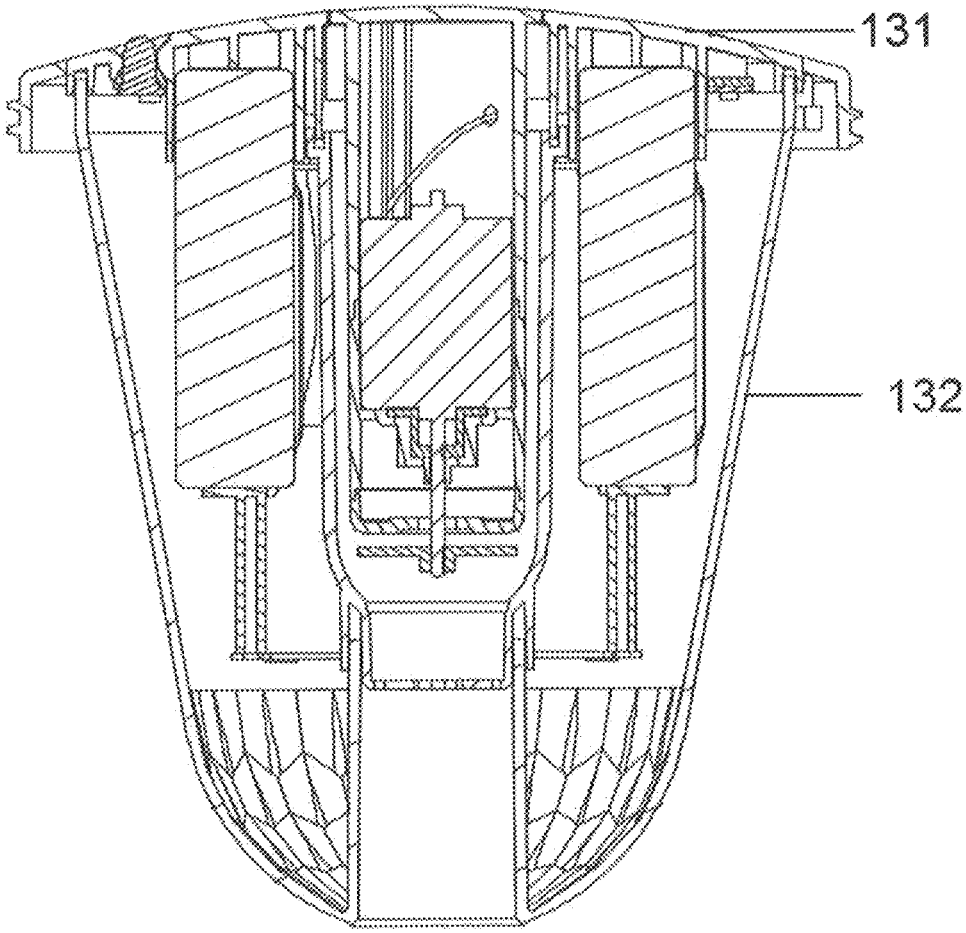
FIG. 7 is a simplified internal structural view of at least one embodiment of the fountain core.
Figure 8:
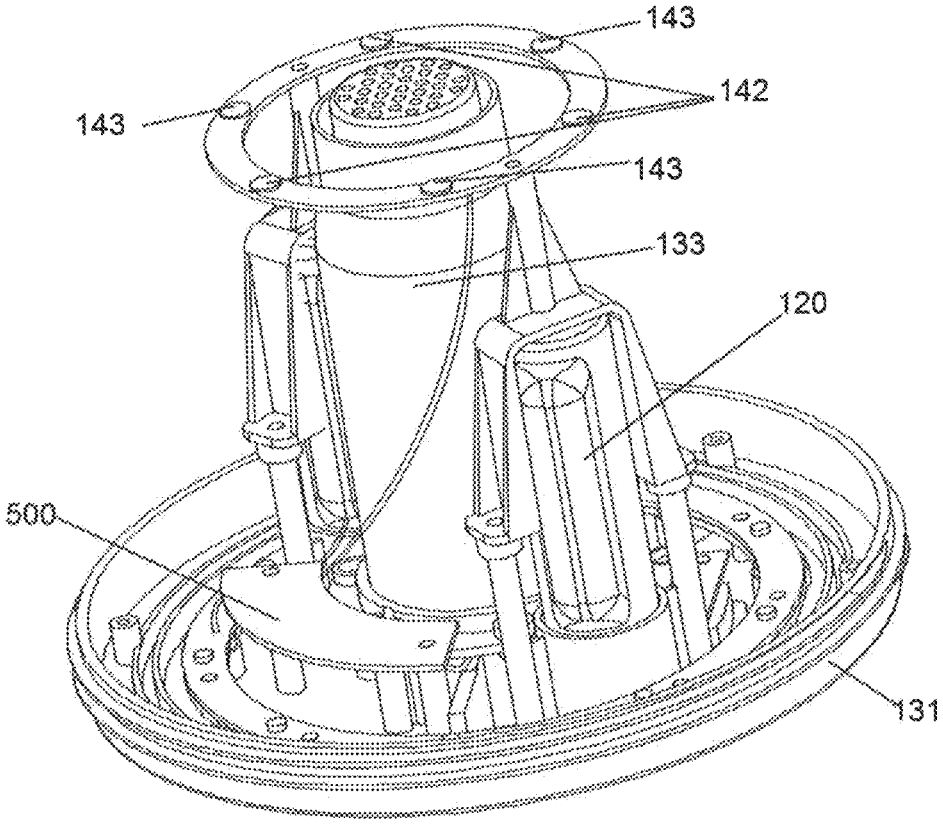
FIG. 8 is an isometric view of at least one embodiment of the fountain core with the second section removed.

In some embodiments, as shown in FIGS. 4 and 5, the arrangement radius of the water spouts 1311 on the top surface of the fountain core 100 is smaller than the arrangement radius of the first lamps 141, and viewed in the axial direction of the fountain core 100, and the arrangement height of the water spouts 1311 is greater than the arrangement height of the first lamps 141, so that the first lamps 141 can obliquely direct at least a portion of the light toward a misty area or a water droplet area of the fountain which is formed from the water spouts 1311. The arrangement radius means the distance between the mounting axis of the first lamps 141 or the arrangement axis of the water spouts 1311 and the axis of the fountain core 100. Alternatively, the arrangement radius may also refer to the distance between the mounting axis of the first lamps 141 or the arrangement axis of the water spouts 1311 and the axis of the core mounting hole 240. Alternatively, the arrangement radius may also refer to the distance between the mounting axis of the first lamps 141 or the arrangement axis of the water spouts 1311 and the axis of the fountain device. The installation height means the distance between the geometric center of the first lamps 141 and the plane of the water inlets as well as the distance between the geometric center of the water spouts 1311 and the plane of the water inlets after the fountain device has been installed. Alternatively, the installation height may also refer to the distance from the geometric center of the first lamps 141 to the plane of the water, as well as the distance from the geometric center of the water spouts 1311 to the plane of the water after the fountain device has been installed. After the water is sprayed, the fountain formed by the fountain device has a misty area or a water droplet area. This relative positional arrangement of the water spouts 1311 and the first lamps 141 at least partially obliquely illuminates the light in the misty area or water droplet area. The light is refracted and/or reflected in the misty area or water droplet area to create a beautiful landscape and festive atmosphere.

In some embodiments, the fountain core 100 is provided with a reflection part 141*a* capable of transforming a point light source of the first lamp 141 into a surface light source. By the reflection, the light emitted by the first lamp 141 can form a cloud with the misty area or water droplet area of the fountain which is formed from the water spout 1311. As shown in FIG. 5, a reflection part 141*a* is disposed in a circular shape in a lamp socket of the first lamp 141, or the lamp socket itself is capable of reflecting light, so that the light of the first lamp 141 can be directed toward the misty area or water droplet area of the fountain after being reflected to form the surface light source, illuminating in a scattered manner a cloud-like region formed by the aforementioned geometric arrangement of the water spouts 1311.

In some embodiments, the plurality of water spouts 1311 are distributed on the circles having at least two radii different from each other, so as to be arranged on the top surface of the fountain core 100 in such a manner as to form at least two water spraying groups, wherein the water spouts 1311 are located at the circles having the different arrangement radii and are adjacent in a radial direction, while the water spouts 1311 in the different arrangement radii are arranged to be staggered from each other along the circumferential direction. That is, the plurality of water spouts 1311 are arranged on the top surface of the fountain core 100 in such a manner as to form at least two water spraying groups respectively located at least two concentric circles with radius different from each other, and the water spouts 1311, which are located at the concentric circles having the different radii and are adjacent in a radial direction of the at least two concentric circles, are arranged to be staggered from each other along a circumferential direction of the concentric circles. As shown in FIG. 5, the fountain core 100 is arranged with two concentric annular water spraying groups, and two adjacent water spouts, which are located at the inner spraying group and at the outer spraying group respectively, are arranged to be staggered from each other along the circumferential direction. With this arrangement, on the one hand, the fountain can have a multi-layered visual effect and enhances the visual effect of the fountain formation in conjunction with the first lamp 141; and on the other hand, this arrangement also enables the fountain device to bear a dynamically changing resultant force so as to generate a disordered motion in the horizontal direction on the water surface.

In some embodiments, the axial length of the core mounting hole 240 is smaller than the axial length of the fountain core 100 such that when the fountain core 100 is installed in position on the floating portion 200, at least a portion of the water inlet 110*a* of the hydraulic portion 110 can extend out of the floating portion 200. Thereby, the fountain core 100 can reliably absorb water in case that the floating portion is inflated.

In some embodiments, the fountain device can float on the water surface when the fountain device is placed in the water. The floating portion 200 is capable of providing buoyancy for the fountain core 100 at locations beyond the outer edge 100*b* of the fountain core 100 along various directions of the water surface.

Figure 2:
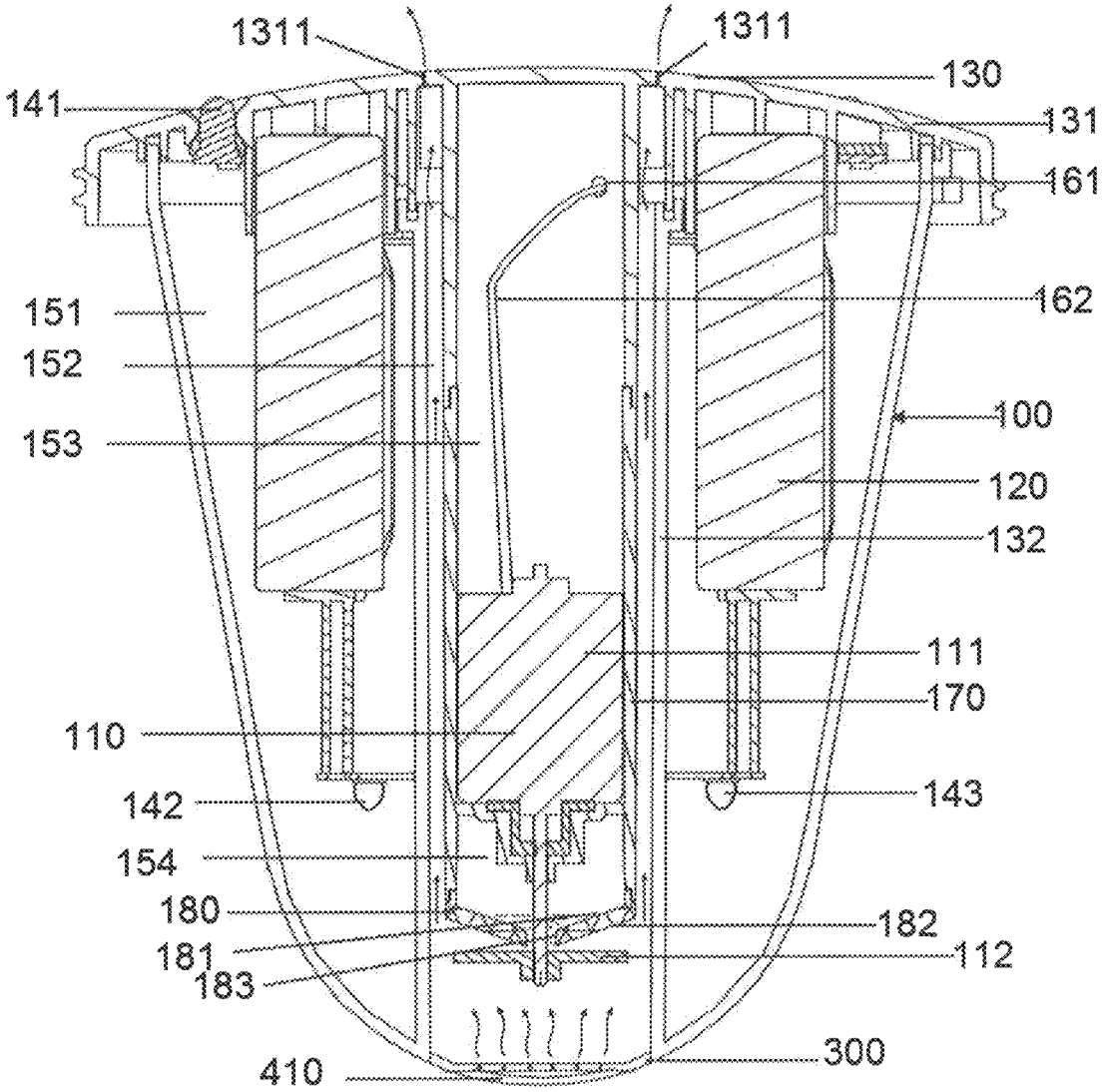
FIG. 2 is a simplified internal structural view of at least one embodiment of a fountain core.
Figure 3:
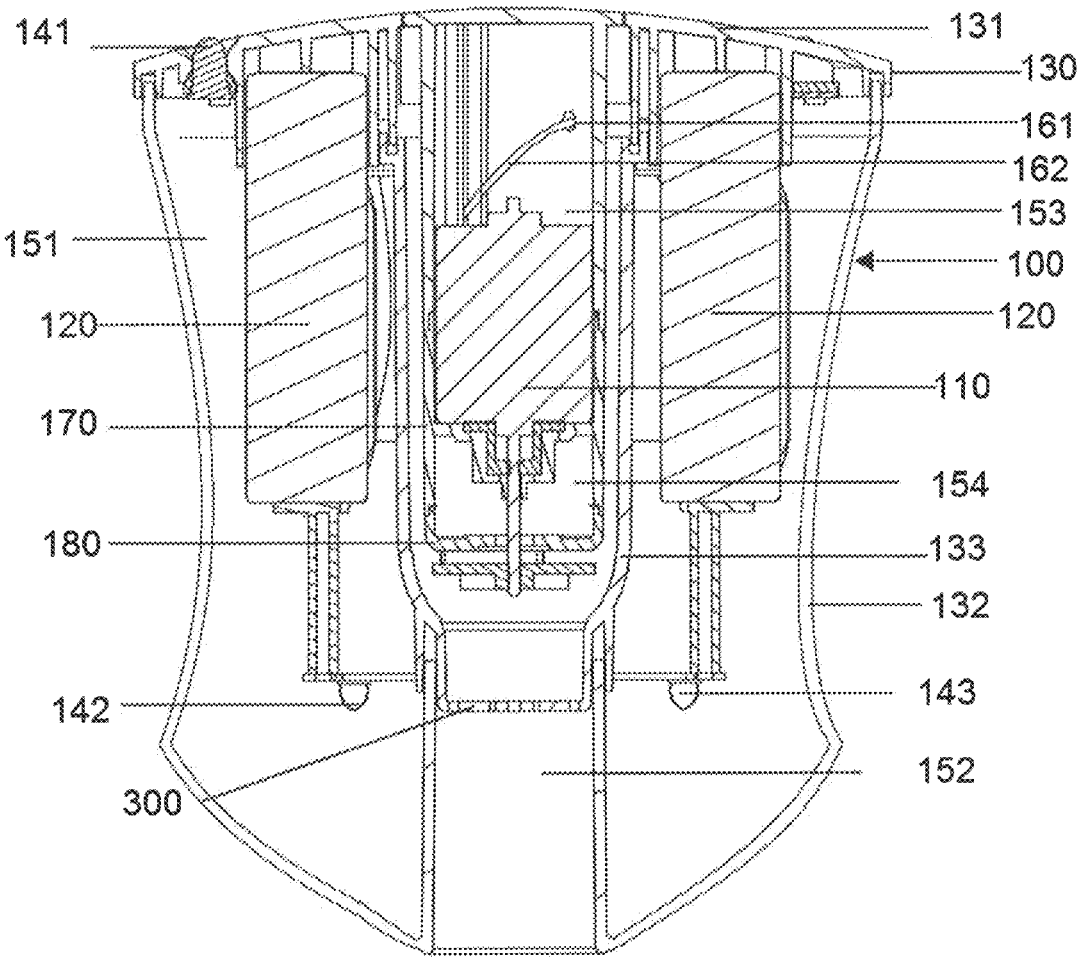
FIG. 3 is a simplified internal structural view of at least one embodiment of the fountain core.

In some embodiments, a fountain core may include at least one of a hydraulic portion, a power supply and a housing, see FIG. 2. The fountain core 100 may include a hydraulic portion 110, a power supply 120 capable of providing power to the hydraulic portion 110, and/or a housing 130 capable of providing at least a waterproof installation space for the power supply 120.

In some embodiments, the fountain core 100 can be detachably coupled to the floating portion 200 to form a fountain device. After the fountain device is placed in the water, the fountain core 100 can float on the water surface along with the floating portion 200 and the water inlets of the hydraulic portion 110 are below the water surface. When the hydraulic portion 110 is powered on by turning on the power supply 120, the hydraulic portion 110 can spray at least a portion of the water entering the water inlets of the hydraulic portion 110 out of the water surface to form a fountain.

In some embodiments, the fountain core 100 can be coupled to a floating portion 200 having different configurations but having an adaptive interface for connection to the fountain core 100, so as to form a fountain device of different configurations. In some embodiments, the floating portion 200 may be in the shape of a flying saucer, a lotus, a lotus leaf or a starfish, see FIG. 10 or FIG. 11. The floating portion 200 can also be shaped like some animals, such as a fish, a duck or a swan.

In some embodiments, the floating portion 200 is provided with a receptacle that can be used for mounting the fountain core 100. The receptacle may be provided in such a manner as to pass through the floating portion 200 from one side thereof to the other side. At least a portion of the receptacle may be provided as an adaptive interface for connection to the fountain core 100. For example, the fountain core 100 may be provided with snaps, threads and/or magnets for detachably attaching to the floating portion 200. A snap, thread and/or magnet adapted for connection to the fountain core 100 can also be provided on the floating portion 200.

Thereby, the present disclosure can achieve at least the following beneficial technical effects as follows: firstly, the shape of the floating portion 200 can be changed so as to quickly meet the needs of different customers for different shapes of the floating portion 200, which can reduce the labor intensity of the designer and reduce the research and development and production cost of the producer; secondly, the customers can use the now existing fountain core 100 with different shapes of floating portions 200 purchased to meet the needs for different occasions or the holiday atmospheres of different festivals, which can reduce the waste of resources and reduce the cost of acquisition for customers.

In some embodiments, the floating portion 200 may be made of a material that has a fixed shape only after inflation, such as, at least one of plastic, PVC and transparent rubber. In some embodiments, the floating portion 200 may form a swim ring shape after inflation. In some embodiments, the fountain core 100 may be provided with a concave structure, so as to snap the fountain core 100 in the inner ring of the swim ring-shaped floating portion 200 by the concave structure after the floating portion 200 is inflated.

In some embodiments, at least part of the floating portion 200 may be of transparent glass or frosted glass.

In some embodiments, the outer surface of the floating portion 200 may have light transmissivity. In at least one embodiment, at least a portion of the light emitted by the light emitting components within the fountain core 100 can be directed onto the floating portion 200 to cause the floating portion to illuminate. In at least one embodiment, at least a portion of the light emitted by the light emitting components within the fountain core 100 can be directed onto the fountain. In at least one embodiment, at least a portion of the light emitted by the light emitting components within the fountain core 100 can be directed into the water. In at least one embodiment, the floating portion 200 exhibits a luminous effect because of at least a portion of the light emitted by the light emitting components within the fountain core 100 directing toward the floating portion 200.

In some embodiments, the floating portion 200 may adopt a unitary structure or a multiple-component structure. The float portion 200 of the unitary structure can be blow molded. The floating portion 200 of the multiple-component structure may be formed by tightly coupling the upper and lower portions.

Figure 9:
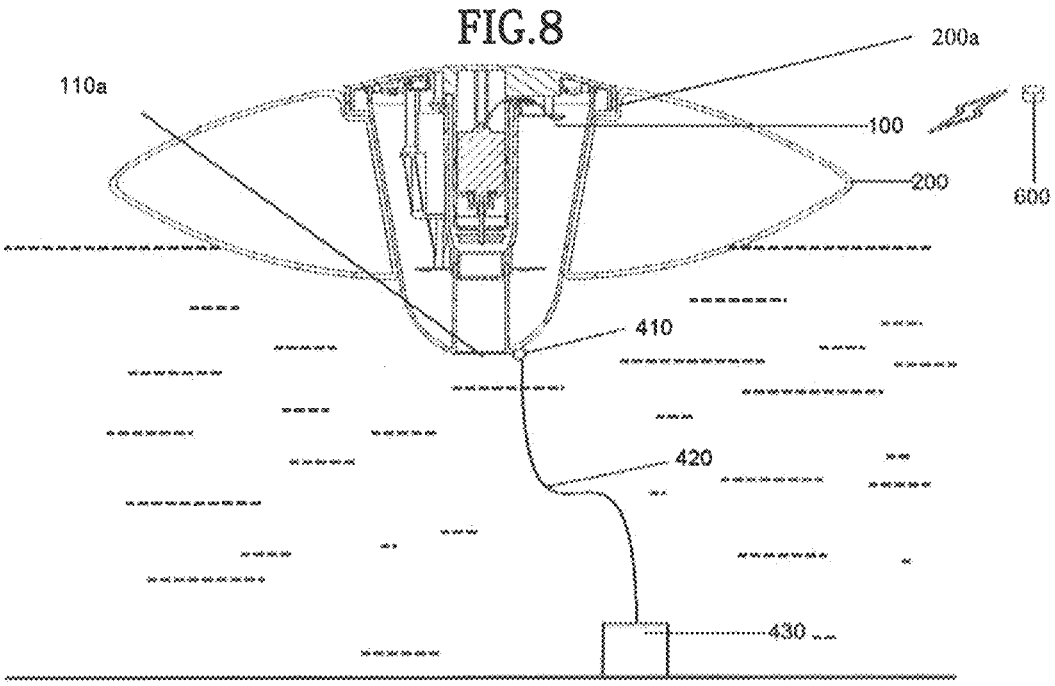
FIG. 9 is a schematic view showing the application of at least one embodiment of a fountain device.
Figure 10:
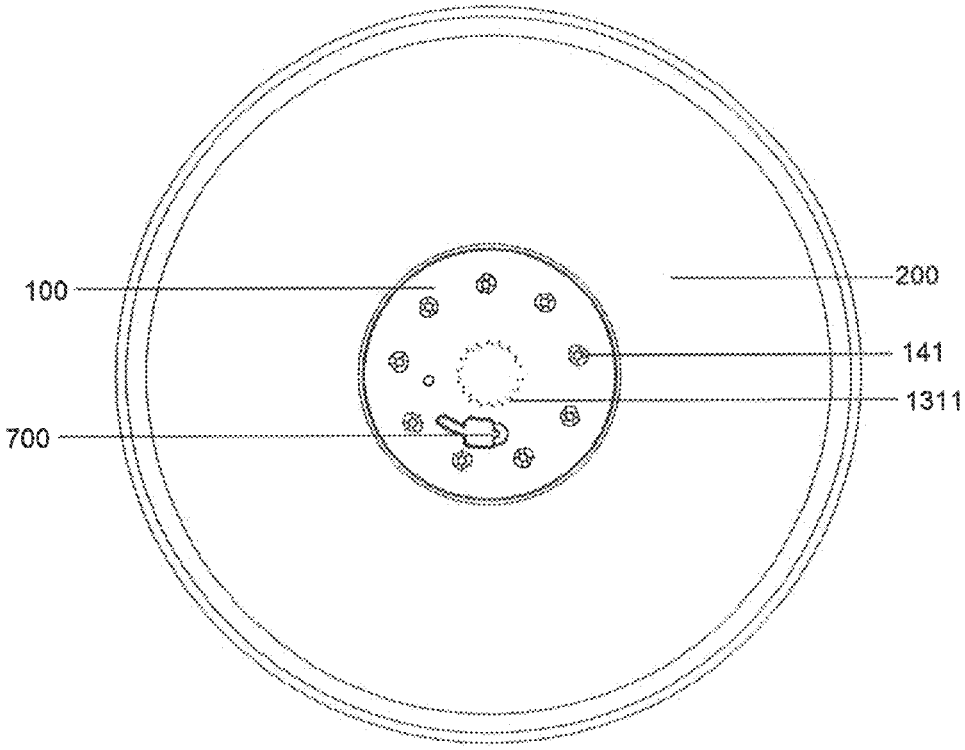
FIG. 10 is a simplified top view of at least one embodiment of the fountain device.
Figure 11:
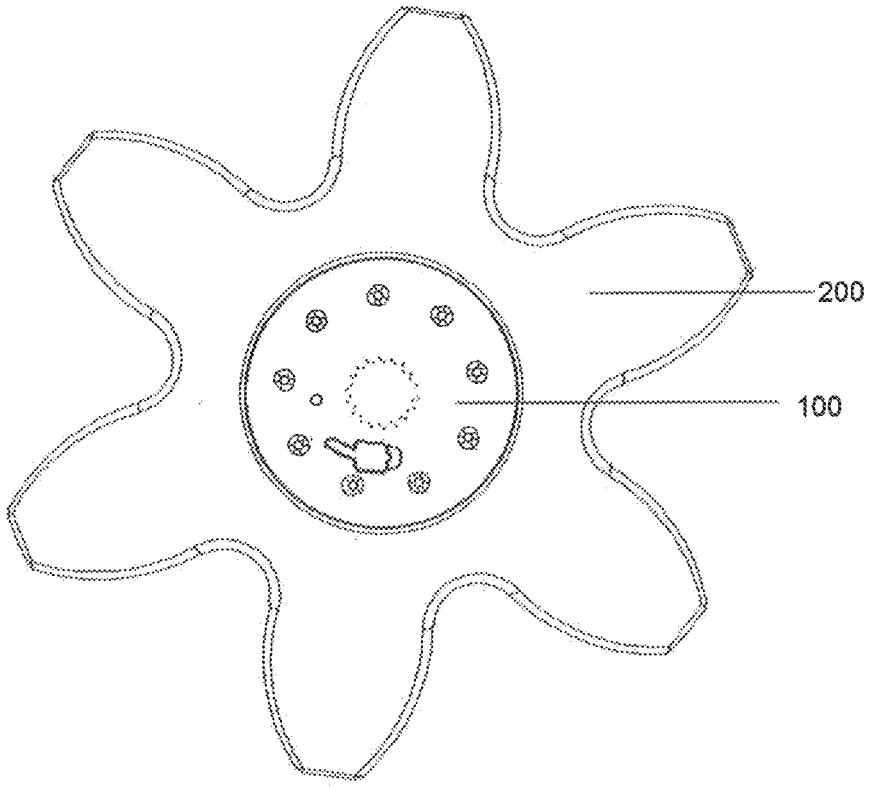
FIG. 11 is a simplified top view of at least one embodiment of the fountain device.
Figure 12:
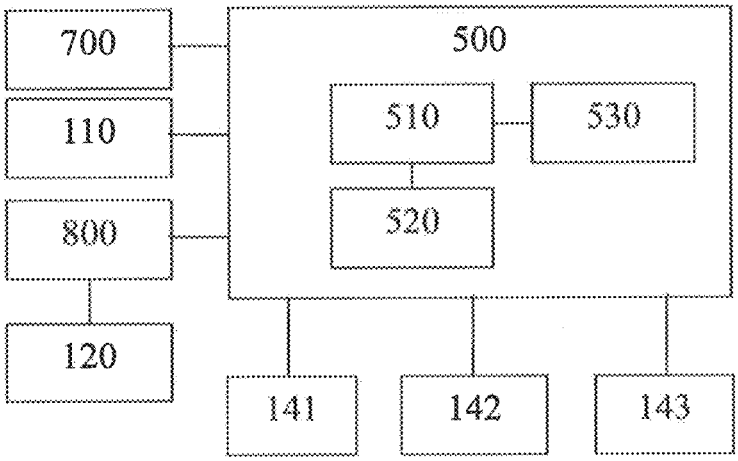
FIG. 12 is a schematic illustration showing the modular connection of the components of the fountain core.

In some embodiments, the floating portion 200 may be partly filled with a buoyancy portion 210 that can float on the water, so as to provide buoyancy by the buoyancy portion 210 when water enters the floating portion 200 in order to prevent the floating portion 200 and/or the fountain core 100 from sinking into the water, see FIG. 9. For example, the buoyancy portion 210 may be a floatable hollow sphere to provide buoyancy by the hollow sphere when water enters the floating portion 200 in order to prevent the floating portion 200 and/or the fountain core 100 from sinking into the water. In at least one embodiment, the hollow spheres may be formed from transparent plastic spheres and/or frosted plastic spheres. As another example, the buoyancy portion 210 can be at least one inflatable bag, to provide buoyancy by the inflatable bag in order to prevent the floating portion 200 and/or the fountain core 100 from sinking into the water. In at least one embodiment, the inflatable bag may be a PO inflatable bag, a PA inflatable bag, and/or a PE inflatable bag. Moreover, when the floating portion 200 is not damaged, the inflatable bag in the floating portion 200 is completely isolated from the environmental air and water. The aging rate of the inflatable bag within the floating portion is slower than that of the inflatable bag exposed directly to the environment. The inflatable bag can function normally at least for a period of time during which water enters the broken floating portion 200.

In some embodiments, a wire binding portion 410 may be provided on the fountain core 100 and/or the floating portion 200. The wire binding portion 410 can be used to tie a limiting wire 420. The other end of the limiting wire 420 can be tied to a counterweight 430. The counterweight 430 sinks into the bottom of the water to limit the range of motion of the floating portion 200 and/or the fountain device. The length of the limiting wire 420 between the wire binding portion 410 and the counterweight 430 may be larger than or equal to the water depth at which the floating portion 200 or the fountain device is located, see FIG. 9. In some embodiments, the wire binding portion 410 can be used to connect with one end of the limiting wire 420. The other end of the limiting wire 420 can be tied to the counterweight 430. The counterweight 430 sinks into the bottom of the water to cause the fountain device to move along a circle with a center on the counterweight by means of the limiting wire 420.

In some embodiments, the fountain core 100 and the floating portion 200 may be configured in such a manner that the fountain core 100 and the floating portion 200 are waterproof independently when the fountain core 100 and the floating portion 200 are placed in water separate from each other.

In some embodiments, the fountain core 100 can be provided with an installation space that provides waterproofing for at least some of the electrical components disposed within the housing 130 and/or on the housing 130. The disclosure can achieve at least the following beneficial technical effects in this way: firstly, the fountain core 100 does not need to be combined with the floating portion 200 to achieve sealing, and has the advantages of high independences and replaceability; secondly, the floating portion 200 is disposed on the periphery of the fountain core 100, which has some protective effects on the fountain core 100. Even if the floating portion 200 is broken, the fluid entering the floating portion 200 cannot flow into the fountain 100, and a safety problem such as a short circuit, is avoided. In some embodiments, the electrical components can be at least one of a power supply 120, a security means, a hydraulic portion 110, a light and a controller.

In some embodiments, the housing 130 can include a first section 131 and a second section 132, see FIG. 2. The first section 131 and the second section 132 may be in close contact with each other to form two chambers separated from each other, i.e., a first chamber 151 and a second chamber 152. The first chamber 151 can be a sealed chamber. The second chamber 152 is communicable with the environment and can be used as a pumping passage for the hydraulic portion 110. The hydraulic portion 110 is installed within the second chamber 152. In at least one embodiment, the lower opening of the second chamber 152 can serve as a water inlet 110*a* of the hydraulic portion 110. After the fountain device is placed in the water, the lower opening of the second chamber 152 is below the water surface. A wire-through hole 161 may be disposed between the first chamber 151 and the second chamber 152. A wire 162 of the power supply 120 in the first chamber 151 can pass from the wire-through hole 161 to the second chamber 152 and is electrically connected to the hydraulic portion 110. In some embodiments, a sealing ring or a sealing tape may be provided between the wire-through hole 161 and the wire 162 to prevent water from flowing from the second chamber 152 into the first chamber 151. In some embodiments, the first section 131 can be provided with a plurality of water spouts 1311. The water spouts 1311 can be disposed in such a manner as to connect the environment to the second chamber 152. The hydraulic portion 110 can send at least a part of the water that enters the water inlets of the hydraulic portion 110 through the water spouts 1311 to spray out of the water surface to form a fountain. When the hydraulic portion 110 is activated, the hydraulic portion 110 applies an upward force to the liquid entering the water inlets of the hydraulic portion 110, and the liquid moves from the lower portion of the second chamber 152 to the upper portion of the second chamber 152, and then spray from the water spouts 1311. In some embodiments, after the fountain core 100 is installed in position on the floating portion 200, the upper surface of the first section 131 and the upper surface of the floating portion 200 are flush or substantially flush at the conjunction.

In some embodiments, the first section 131 and the second section 132 may be directly coupled tightly. For example, the middle portion of the first section 131 may have an inner wall that projects toward the second section 132. The middle portion of the second section 132 may have an inner wall that projects toward the first section 131. When the outer wall of the first section 131 and the outer wall of the second section 132 are tightly coupled with each other, the inner wall of the middle portion of the first section 131 that protrudes toward the second section 132 is tightly coupled with the inner wall of the middle portion of the second section 132 that projects toward the first section 131, such that the first chamber 151 and the second chamber 152 are isolated from each other, see FIG. 5.

In some embodiments, the housing 130 can include a first section 131, a second section 132, and a third section 133. At least a portion of the first section 131 and the second section 132 may be indirectly coupled tightly by means of the third section 133. For example, the first section 131 is indirectly coupled tightly to the second section by the third section 133, see FIG. 3.

In some embodiments, a filter element 300 may be disposed between the hydraulic portion 110 and the pool of water. For example, the filter element 300 can be disposed on the third section 133, see FIG. 3. As another example, a filter structure can be disposed on the second section 132. The filter structure is configured as a separate screen cover that can be snapped or threaded to the second section 132. In some embodiments, the filter element 300 can be used to filter the water flow before the water flow flows to the impeller 112, so as to reduce the chance of blockage of the pumping passage.

In some embodiments, the fountain core 100 can include a pump seat 170. The first section 131 can be coupled to the second section 132 to form a first chamber 151 that can be used to accommodate at least some of the electronic or electrical components and a second chamber 152 that can act as a pumping passage for the hydraulic portion 110. The first section 131 can be coupled to the pump seat 170 to form a third chamber 153 that can be used to accommodate the hydraulic portion 110. In some embodiments, the third chamber 153 is located within the second chamber 152. In some embodiments, the first section 131 and the pump seat 170 may be configured such that, the first section 131 is coupled to the pump seat 170 so as to form the third chamber 153 which is capable of accommodating the hydraulic portion 110 and provides isolation from the second chamber 152 for a motor 111 of the hydraulic portion 110, so as to prevent water in the second chamber 152 from entering the third chamber 153.

In some embodiments, the fountain core 100 or the housing 130 may be configured such that, an air cavity is formed between the motor 111 of the hydraulic portion 110 and the impeller 112 of the hydraulic portion 110 to reduce the direct impact of the water flow on the hydraulic portion 110 or the sealing structure of the hydraulic portion 110. For example, the fountain core 100 can include a water blocking portion 180. The water blocking portion 180 is disposed between the pump seat 170 and the impeller 112 and is in tight contact with the pump seat 170 to form a fourth chamber 154 between the motor 111 of the hydraulic portion 110 and the impeller 112. The opening of the fourth chamber 154 faces downward so as to form an air cavity between the motor 111 of the hydraulic portion 110 and the impeller 112 of the hydraulic portion 110 to reduce the direct impact of the water flow on the sealing structure of the hydraulic portion 110. In some embodiments, the bottom of the inner wall of the water blocking portion 180 facing the fourth chamber 154 may be configured as a first inverted cone surface 181 which gradually decreases from the top to the bottom, to allow the liquid in the fourth chamber 154 to flow down to the second chamber 152 by gravity. The present disclosure achieves at least the following advantageous technical effects in this way: firstly, it facilitates the liquid in the fourth chamber 154 flowing out, particularly when the fountain core 100 is taken out of the water and then put in storage, water storing in the fourth chamber 154 can be prevented; secondly, when the hydraulic portion 110 pumps water, because the bottom of the inner wall of the water blocking portion 180 facing the fourth chamber 154 is configured as the first inverted cone surface 181 which gradually decreases from the top to the bottom, part of the water can enters the fourth chamber 154 under the effect of the pumping water by the hydraulic portion 110, and can quickly accumulate at the bottom of the first inverted cone surface 181 due to gravity to form a water sealing film having a certain thickness; with more water entering the fourth chamber 154, an increased internal air pressure creates a reaction force against external water pressure, which prevents external water flow from entering the fourth chamber 154.

In some embodiments, the outer wall of the water blocking portion 180 facing the second chamber 152 may be configured as a second inverted cone surface 182 that gradually decreases from the top to the bottom. The second chamber 152 and the second inverted cone surface 182 may be disposed in such a manner that the cross-sectional area of the passage of the water flow gradually decreases from the bottom to the top in the region where the second inverted cone surface 182 is located. The present disclosure can achieve at least the following beneficial technical effects in this way: firstly, the method can pressurize the water flow; secondly, the method can reduce the kinetic energy of the fountain core 100 converted when the water flow impinges on the water blocking portion 180, and thus more energy are converted into the kinetic energy of the fountain.

In some embodiments, the outer wall of the water blocking portion 180 facing the second chamber 152 may be configured as a plane perpendicular or substantially perpendicular to the motor shaft of the hydraulic portion 110, to allow a portion of the water to impinge on the water blocking portion 180 so as to convert into the kinetic energy of the fountain core 100 each time pumping water is started. The present disclosure can at least achieve the following beneficial technical effects in this way: firstly, the method can also pressurize the water flow; secondly, the method can increase the kinetic energy of the fountain core 100 converted by the water flow impinging on water blocking portion 180, especially when pumping water is started, so as to allow the fountain device to shake with a bigger amplitude on the water surface.

In some embodiments, the inner wall of the bottom hole of the water blocking portion 180 surrounding the motor shaft of the hydraulic portion 110 may be configured as a third inverted cone surface 183 that gradually decreases from the top to the bottom. The upper portion of the third inverted cone surface 183 is engageable with the first inverted cone surface 181. The lower portion of the third inverted cone surface 183 is engageable with the second inverted cone surface 182. The taper angle of the third inverted cone surface 183 may be smaller than the taper angle of the first inverted cone surface 181.

In some embodiments, the projection contour of the bottom hole of the water blocking portion 180 does not overlap with the projection contour of the plurality of blades of the impeller 112 of the hydraulic portion 110 when projected to a plane perpendicular to the motor shaft of the hydraulic portion 110. For example, the projected contours of several impellers 112 may surround the periphery of the projected contour of the bottom hole and have no intersections with each other. Since the middle portion of the blade of the impeller 112 has a connecting portion for connecting the plurality of blades, the connecting portion is generally cylindrical in shape such that the cross-sectional area of the bottom hole is smaller than the cross-sectional area of the connecting portion to avoid water flow with high velocity, allowing less water to enter the fourth chamber 154. In some embodiments, the shortest distance between the water blocking portion 180 and the impeller 112 can be set to be 1 to 20 mm, and particularly preferably 2 to 3 mm.

In some embodiments, the first lamp 141 is mountable within the first chamber 151. At least a portion of the first lamp 141 extends beyond the housing 130 or the first section 131, so as to at least partially direct the light emitted from the first lamp 141 toward the fountain sprayed from the fountain core 100. A gasket may be disposed between the first lamp 141 and the first section 131 to prevent water from flowing from the first lamp 141 into the first chamber 151. As another example, the first lamp 141 can be mounted within the first chamber 151 and at least partially directs light emitted from the first lamp 141 toward the fountain sprayed from the fountain core 100 through the at least partially transparent first section 131. In some embodiments, the first lamp 141 is disposed in such a manner that the light emitted by the first lamp 141 can be at least partially directed onto the floating portion 200. In some embodiments, one portion of the light emitted by the first lamp 141 is directed onto the fountain and another portion of the light can be transmitted through the first chamber 151 onto the floating portion 200. The fountain core can include at least one second lamp 142. The second lamp 142 can be mounted within the first chamber. The second lamp 142 can be disposed in such a manner that the light emitted by the second lamp 142 can be at least partially directed toward the floating portion and/or toward the bottom of the water.

In some embodiments, the second section 132 can be disposed in such a manner that the end of the second section 132 remote from the first section 131 is completely concealed within the floating portion 200 after the fountain core 100 is mounted in position on the floating portion 200.

In some embodiments, the second section 132 can be disposed in such a manner that a portion of the second section 132 protrudes beyond the floating portion 200 in a direction away from the first section 131 after the fountain core 100 is mounted in position on the floating portion 200.

In some embodiments, the outer surface of the portion of the second section 132 that protrudes beyond the floating portion 200 may be configured as a multiple-facet joint or stacked structure, such as a diamond cut surface or a diamond-like cut surface. Another example is a fish scale or a fish scale-like shape, see FIG. 7. The disclosure can achieve at least the following beneficial technical effects in this way: firstly, the disassembly can be simplified when disassembling the fountain core; secondly, the surface is not easy to form continuous scratches when hitting the edge of the pool or the object in the pool; thirdly, when the second lamp shines through the second section toward the bottom of the water, the bottom of the water forms a texture, which forms a good decorative effect with less resources.

In some embodiments, fountain core 100 can include at least one second lamp 142. The second lamp 142 is mounted within the first chamber 151. The second lamp 142 can be disposed in such a manner that the light emitted by the second lamp 142 can be at least partially directed onto the floating portion 200. The second lamp 142 can be disposed in such a manner that the light emitted by the second lamp 142 can be at least partially directed toward the bottom of the water. In at least one embodiment, the second lamp 142 is positioned in such a manner that, at least part of the light emitted by the second lamp 142 directs toward the water body around the fountain core 100 by means of one portion of the second section 132 that protrudes beyond the floating portion 200 in a direction away from the first section 131. In at least one embodiment, the second lamp 142 can be disposed adjacent to the bottom of the floating portion 200 to allow the light emitted by the second lamp 142 to be able to at least partially direct toward the floating portion 200 and the light emitted by the second lamp 142 to be able to at least partially direct toward the bottom of the water. Further, in the case where the second section 132 is disposed in such a manner that one portion of the second section 132 protrudes beyond the floating portion 200 in a direction away from the first section 131 after the fountain core 100 is mounted in position on the floating section 200, the area illuminated by the light that is directed to the bottom of the water is greater, and fewer fountain devices are needed to achieve scenery requirements, and costs, resources and energy are saved.

In some embodiments, the first lamp 141 and/or the second lamp 142 may be LED lights. The first lamp 141 and/or the second lamp 142 may be LED monochromatic lamps. For example, the LED monochrome light can be one of red, orange, blue, green, yellow, and purple. The first lamp 141 and/or the second lamp 142 may be LED color lights. For example, an LED color lights can emit at least two colors of red, orange, blue, green, yellow, and purple.

In some embodiments, the fountain core 100 can include at least one third lamp 143. The third lamp 143 is mounted within the first chamber 151. The third lamp 143 is an ultraviolet lamp for disinfection of the water. The third lamp 143 is disposed in such a position that, the fountain machine in such a manner that part or all of the ultraviolet light emitted from the third lamp 143 can be directed toward the water body around the fountain core 100 by means of one portion of the second section 132 that protrudes beyond the floating portion 200 in a direction away from the first section 131.

In some embodiments, at least a portion of the water in the fountain that sprays out of the water can strike the fountain core 100 and/or the floating portion 200 to cause the fountain device to shake on the water surface. The present disclosure can at least achieve the following beneficial technical effects in this way: firstly, the position of the fountain device can be shaken due to water spraying, and in the case where there are multiple fountain devices in the pool of the scenery, a dynamic scenery effect can be formed, and in the case of light illumination, the shaking of the floating lights can also achieve a dynamic changing scenery effect with fewer hardware devices, and if the decorative lights are used, not only the layout procedure is complicated, but also the wiring and recycling are troublesome, which means waste of resources and waste of manpower; secondly, in the case where the fountain device opens the third lamp 143, the area of the water body disinfected by the fountain device can be expanded with the shaking of the fountain device; thirdly, the shaking and disordered movement of the fountain device in combination results in water disinfection, resources saving and energy saving.

In some embodiments, at least a portion of the water in the fountain that sprays out of the water surface falls to the circumference of the floating portion 200 to produce water waves to cause the fountain device to shake on the water surface. In some embodiments, the circumference of the floating portion 200 may refer to a circular area centered on the floating portion 200. The radius of the circular area can range from 0.1 to 3 meters.

In some embodiments, a power supply 120 is electrically connected to a control board 500 to provide power thereto. The control board 500 is coupled to the hydraulic portion 110, the first lamp 141, the second lamp 142, and/or the third lamp 143, see FIG. 3 or FIG. 8. In some embodiments, the power supply 120 can be a rechargeable battery, for example, the power supply 120 can be a lithium battery.

In some embodiments, the fountain core 100 can include a charging interface 700. The charging interface 700 can be disposed on the housing 130, see FIG. 10. The charging interface 700 can be coupled to the power supply 120 to charge the power supply 120 through a power adapter. The charging interface 700 can be indirectly connected to the power supply 120 via a control board.

In some embodiments, the fountain core 100 can include a switch 800. The switch 800 can be coupled to the control board. The power supply 120 can be indirectly connected to the control board via the switch 800 to turn on or off the power to the control board. In at least one embodiment, the switch 800 is provided on the housing 130 in such a manner as to be operable from the outside, for example on the first section.

In some embodiments, at least one of the hydraulic portion 110, the first lamp 141, the second lamp 142, and the third lamp 143 may be controlled by means of the control board 500. For example, the control board 500 controls the hydraulic portion 110, the first lamp 141, the second lamp 142, and the third lamp 143 to simultaneously turn on or off. Alternatively, the control board 500 controls the hydraulic portion 110, the first lamp 141, the second lamp 142, and the third lamp 143 to be turned on or off periodically. In some embodiments, the control board 500 can be an existing hardware module. In some embodiments, the control board, processor and/or wireless remote controller disclosed herein may not be comprised of software functional modules, but may be comprised of combinations and connection relationships of various hardware. For example, the control board, processor, and/or wireless remote controller can be an application specific integrated circuit (ASIC), an FPGA, a general purpose computer, or any other hardware equivalent, etc.

In some embodiments, a method of controlling a fountain device may include: controlling at least one of the hydraulic portion 110, the first lamp 141, the second lamp 142, and the third lamp 143 by means of the control board 500.

In some embodiments, the control board 500 may be configured to individually turn on or off one of the hydraulic portion 110, the first lamp 141, the second lamp 142 and the third lamp 143. The control board 500 may be configured to simultaneously turn on at least two of the hydraulic portion 110, the first lamp 141, the second lamp 142 and the third lamp 143. The control board 500 can be configured to control the first lamp 141 or the second lamp 142 to change the illuminating color.

In some embodiments, the control board 500 can be configured to intermittently control the hydraulic portion 110 to pump water to form an intermittent fountain. The disclosure can achieve at least the following beneficial technical effects in this way: firstly, electricity can be saved, and working time can be increased when an equal amount of electric energy is used; secondly, the hydraulic portion is prevented from being damaged prematurely by continuously running the hydraulic portion for a long time; thirdly, the effect of the disorder movement of the fountain core is more obvious.

In some embodiments, control board 500 can include a processor 510, a memory 520, and/or a wireless module 530. The processor 510 is coupled to the memory 520 and the wireless module 530. The fountain device can include a wireless remote controller 600. The control board 500 can receive a control command from the wireless remote controller 600 via the wireless module 530. The control board 500 can receive a control command from the wireless remote controller 600 via the wireless module 530 to control at least one of the hydraulic portion 110, the first lamp 141, the second lamp 142 and the third lamp 143. The wireless module 530 can be, for example, a Bluetooth module, an infrared module, or a ZigBee module.

In some embodiments, the control board 500 can control at least one of the hydraulic portion 110, the first lamp 141, the second lamp 142 and the third lamp 143 by means of hardware means such as an FPGA. In some embodiments, the control board 500 can control at least one of the hydraulic portion 110, the first lamp 141, the second lamp 142 and the third lamp 143 by means of at least one instruction stored in the memory 520 on the control board 500.

The fountain device according to some embodiments of the present disclosure has a plurality of water spouts distributed along the circumferential direction of the top surface, compared to the float portion formed by the rigid housing. These water spouts spray water in the radial direction outward and generate upward and radially outward forces at the same time, so reaction forces of the forces have not only vertical components but also horizontal components, which will push the fountain device of the present disclosure to move on the water surface. In terms of volume to weight ratio, the floating portion itself is lighter, and thus is susceptible to fluctuations in the water surface. The up and down fluctuations of the water surface will enhance the change of the water spraying direction of the water spouts, thereby further enhancing the fountain device to move on the water surface.

Furthermore, the fountain device according to some embodiments of the present disclosure may achieve the other advantages are:

1. The floating portion forms an inflatable floating structure by injecting a low-density fluid, and is installed separately from the fountain core, which enables the floating portion in the expanded state to be in a foldable form by discharging the low-density fluid when the fountain device is in use, so that it is convenient for staff to store and take along;

2. The floating portion can be made of a flexible material, and the core mounting hole thereof can also be flexible. Therefore, the core mounting hole formed when the floating portion is inflated can be matched with the fountain core and can in particular keep the fountain core tightly held; secondly, the flexible core mounting hole has a deforming capability, which facilitates creating a horizontal movement by the reaction force;

3. The core mounting hole has such a passage length and cross-sectional shape that, on the one hand, the fountain core can slide through the floating portion or rotate therein during installation, and on the other hand, the reaction force generated when spraying water causes the fountain device to move;

4. The floating portion inflates by injecting a low density fluid. The low density fluid aids the fountain device to at least partially immerse in the liquid outside;

5. The injected low density fluid is optional. The low density fluids of different densities can form disordered movements with different amplitudes and degrees of shake. Users can inject different low density fluids by the injection interface on the floating portion for different scenes. For example, for disordered movement with a big amplitude of shake, a gas may be selectively injected; for a disordered movement with a slight and small amplitude of shake, alcohol may be selectively injected; in the present disclosure, the low density fluid means a fluid in which the density is less than or equal to the density of the external fluid. For example, if the external fluid is water, the density of the low density fluid is less than the density of water. For example, the low density fluid may be air, inert gas, nitrogen, alcohol or gasoline, etc.; and of course the low density fluid may be water itself;

6. In the process of disordered movement for the fountain device, the fountain core interacts with the core mounting hole. The flexible core mounting hole has the functions of absorbing vibration and deformation, which can effectively protect the hydraulic device and the power supply inside the fountain core when the fountain core collides with the core mounting hole. However, the rigid floating housing in prior art will collide with the fountain core, which will cause damage to the internal structures in the fountain core and the housing; and 7. The volume of low density fluid injected can be determined according to the scene. If the water spray of the fountain device is required to be exposed to the water surface, the floating portion can be filled entirely; if the water spray of the fountain device is required to partially submerge into the water surface, a small amount of low density fluid can be injected into the floating portion. In contrast to the structure of the rigid housing, the fountain device which can be submerged in water and emits light according to the present disclosure can bring about a color-changing and cloud-like light ball effect at night.

In some embodiments, the floating portion has an interface 200*a* for connecting with the fountain core, such that in case that the fountain core is mounted in the core mounting hole, the fountain device can float on the water surface in such a manner that its geometric center or geometric center of gravity is located within the core mounting hole. The advantages of this arrangement are as follows: 1. the interface has a guiding function to facilitate the installation of the fountain core; 2. the interface has the function of fixedly installing the fountain core; 3. since the geometric center or geometric center of gravity of the fountain device is located in the core mounting hole, which facilitate the fountain device to produce disordered movement without causing intensive movement, so that the intensive movement will be mistaken by the user as mechanical failure; 4. the structural length of the core mounting hole can meet the requirement that the center of gravity or the geometric center of the fountain device runs through the core mounting hole. Since the floating portion of the flexible material is significantly lighter than the fountain core, the center of gravity of the fountain device is determined by the fountain core. Thus, the center of gravity can be adjusted by adjusting the distance of the water pump from the plane of the water spouts and/or the battery mounting position. For example, if the water pump is installed close to the water spout, the center of gravity of the fountain device is close to the water spout, thereby effectively limiting the shaking amplitude of the fountain device; if the water pump is installed close to the water inlet 110*a*, the center of gravity of the fountain device can be close to the lower side, thereby effectively limiting the shaking amplitude of the fountain device; 5. the center of gravity or geometric center of the fountain device also depends on the type and volume of the injected low density fluid, so the center of gravity and/or geometric center of the fountain device can be adjusted by adjusting the type and volume of the fluid injected.

In some embodiments, during the formation of the fountain by the hydraulic portion delivering at least a portion of the water which enters a water inlet of the hydraulic portion to the water spout, the fountain device is capable of producing a disordered movement in the horizontal direction on the water surface due to sustaining a dynamically changing resultant force. In some embodiments, viewed in the circumferential direction of the fountain core, a plurality of water spouts are distributed on the circles having at least two radii different from each other, so as to be arranged on the top surface of the fountain core in such a manner as to form at least two concentric annular water spraying groups, wherein the water spouts which are located at the circles having the different arrangement radii and are adjacent in a radial direction are arranged to be staggered from each other in the circumferential direction. By this arrangement of the water spouts, it is not necessary to precisely control the water spraying direction and the water spraying force of the water pump independently, but a horizontal force component is present all the time by merely relying on the structural arrangement. In case of water sprayed at a constant velocity, this component is determined by the structure of the fountain device and acts generally in only one direction. For a fountain device that is circular in the whole, the force component along one direction causes the fountain device to continue to rotate in one direction, resulting in a continuously varying fountain effect. In case of intermittent water spraying, this component is determined by the water amount of one single spraying, the time interval between two adjacent sprayings, and the structure of the fountain device. The water amount of one single spraying can affect the horizontal force component generated by this water spraying, so that for the overall circular fountain device, the force component in one direction causes the fountain device to continue to rotate in one direction, and after the end of the water spraying, the motion of the fountain device is continued due to inertia until the kinetic energy is exhausted or the next water spraying starts. For intermittent water spraying having a water spraying interval, the period of disorderly movement by the intermittent water spraying can be determined, so that the fountain device can have intermittent disordered movement with a period, thereby obtaining an intermittent randomly changing fountain effect.

In some embodiments, the fountain core further includes at least one first lamp, the first lamp extending at least partially beyond a housing, so that the light emitted by the first lamp is at least partially directed obliquely toward the fountain sprayed from the fountain core. In some embodiments, the arrangement radius of the water spouts on the top surface of the fountain core is smaller than the arrangement radius of the at least one first lamp, and viewed in the axial direction of the fountain core, and the arrangement height of the water spouts is greater than the arrangement height of the at least one first lamp, so that the at least one first lamp can obliquely direct at least a portion of the light toward a misty area or a water droplet area of the fountain which is formed from the water spout. In some embodiments, a plurality of water spouts are distributed on the circles having at least two radii different from each other, so as to be arranged on the top surface of the fountain core in such a manner as to form at least two concentric annular water spraying groups, wherein the water spouts which are located at the circles having the different arrangement radii and are adjacent in a radial direction are arranged to be staggered from each other in the circumferential direction. In this way, at least the advantages of the present disclosure are as follows: 1. the water spouts arranged in this manner help to weaken the intensity of the disordered movement; 2. the spouts are provided on at least two concentric circles, so that the generated fountain has at least two layers and can generate a water droplet area or a misty area with a fan-shaped like surfaces of different heights, especially that, with the assistance of the disordered movement, the light generated by the first lamp or sunlight can be obviously diffused in the water droplet area or the misty area. This will form a rainbow to some extent, which will help to create a festive atmosphere.

In some embodiments, the fountain core is provided with a reflection part 141*a* capable of transforming a point light source of the at least one first lamp into a surface light source, so that the light emitted by the at least one first lamp can form a cloud with the misty area or water droplet area of the fountain which is formed from the water spout.

In some embodiments, when the fountain core is installed in position on the floating portion, at least a portion of the water inlet 110*a* of the hydraulic portion can extend out of the floating portion. With this arrangement, the present disclosure also has the advantage that, a low pressure zone is generated at the water inlet 110*a* when pumping water, and the fountain device fluctuates up and down under the action of the upper liquid pressure and the gravity of the fountain device.

In some embodiments, the fountain device can float on the water surface when the fountain device is placed in the water, and the floating portion is capable of providing buoyancy for the fountain core at locations beyond the outer edge 100*b* of the fountain core along various directions of the water surface.

In some embodiments, the core mounting hole is configured to at least partially match a shape of the housing of the fountain core in case that the floating portion is injected with a low density fluid, such that when the floating portion is injected with a low density fluid, the floating portion inflates so that at least a portion of its surface 200*b* at the core mounting hole is abutted against a circumferential wall 130*a* of the housing of the fountain core, so as to mount the fountain core on the floating portion.

The term "module" as used herein refers to any hardware, software, or combination of hardware and software that is capable of performing the functions associated with the "module".

It should be noted that the above specific embodiments are exemplary, and those skilled in the art can devise various solutions motivated by the disclosure of the present disclosure, and these solutions are also within the scope of the present disclosure and fall into scope of protection of the present disclosure. It should be understood by those skilled in the art that the illustrations of the description and drawings are illustrative and not restrictive to the claims. The scope of the disclosure is defined by the claims and their equivalents.

What is claimed is:

1. A fountain device comprising:

a fountain core (100) comprising:

a hydraulic portion (110); and a power supply (120) for providing power to the hydraulic portion (110), wherein the hydraulic portion (110) comprises:

a water pump to pump an amount of water from a water inlet (110*a*) at a lower portion of the hydraulic portion (110) and spray the water via a plurality of water spouts (1311) at an upper portion of the hydraulic portion (110) to form a water spray; and a floating portion (200) that is inflatable and foldable configured to cause the fountain device to float on a water surface when the floating portion (200) is inflated, wherein the floating portion (200) comprises a core mounting hole (240) that holds the fountain core (100), so that the fountain core (100) can form the water spray by the hydraulic portion (110) in a state that the fountain device floats on a water surface, wherein the plurality of water spouts are arranged on a top surface of the fountain core (100) in such a manner as to form at least two water spraying groups located at least two concentric circles with radii different from each other respectively, wherein the at least two concentric circles form at least one inner concentric circle and at least one outer concentric circle arranged in an outwardly radial direction, wherein the water spouts, which are located at the at least two concentric circles are arranged to be staggered from each other along a circumferential direction of the at least two concentric circles, and wherein the water spouts are configured to produce a disordered movement of the fountain device in a horizontal direction on the water surface.

2. The fountain device according to claim 1, wherein one end of the inflatable floating portion (200) has an interface (200*a*) configured to connect with the fountain core (100), such that in case that the fountain core (100) is mounted in the core mounting hole (240), the fountain device can float on a water surface in such a manner that a geometric center or geometric center of gravity of the fountain device is located within the core mounting hole (240).

3. The fountain device according to claim 1, wherein the fountain core (100) further comprises at least one first lamp (141) configured to extend at least partially beyond a housing (130), so that the first lamp (141) emits light at least a portion of which irradiates obliquely toward the fountain sprayed from the fountain core (100).

4. The fountain device according to claim 3, wherein an arrangement radius of the water spouts (1311) on a top surface of the fountain core (100) is smaller than an arrangement radius of the at least one first lamp (141), and an arrangement height of the water spouts (1311) is greater than an arrangement height of the at least one first lamp (141) when viewed in an axial direction of the fountain core (100), so that the at least one first lamp (141) emits light at least a portion of which irradiates obliquely toward a misty area or a water droplet area of the fountain formed by the water spout (1311).

5. The fountain device according to claim 4, wherein the fountain core (100) is provided with a reflection part (141*a*) configured to transform a point light source of the at least one first lamp (141) into a surface light source, so that the light emitted by the at least one first lamp (141) can form a cloud with the misty area or water droplet area of the fountain which is formed by the water spout (1311).

6. The fountain device according to claim 1, wherein the fountain core (100) is configured to detachably couple to the floating portion (200) to form the fountain device.

7. The fountain device according to claim 1, wherein the fountain core (100) is mounted in on the floating portion (200), at least a portion of the water inlet (110*a*) of the hydraulic portion (110) can extend out of the floating portion (200).

8. The fountain device according to claim 1, wherein the floating portion (200) is configured to provide buoyancy for the fountain core (100) at locations beyond an outer edge (100*b*) of the fountain core (100) along various directions of the water surface.

9. The fountain device according to claim 1, wherein the core mounting hole (240) is configured to form a shape at least partially matching with a shape of a housing (130) of the fountain core (100), such that the floating portion (200) inflates so that at least a portion of its surface (200*b*) at the core mounting hole (240) is abutted against a circumferential wall (130*a*) of the housing (130) of the fountain core (100), so as to mount the fountain core (100) on the floating portion (200).

* * * * *